United States Patent [19]

Chynoweth

[11] 4,429,179

[45] Jan. 31, 1984

[54] WOVEN WIRE FANOUT

[75] Inventor: William R. Chynoweth, Littleton, Colo.

[73] Assignee: Honeywell Inc., Minneapolis, Minn.

[21] Appl. No.: 378,034

[22] Filed: May 14, 1982

[51] Int. Cl.[3] ..... H01B 7/08

[52] U.S. Cl. ..... 174/117 M; 174/117 F; 139/425 R

[58] Field of Search ..... 174/117 F, 117 M; 139/425 R

[56] References Cited

U.S. PATENT DOCUMENTS

| | | | |
|---|---|---|---|
| 3,627,903 | 12/1971 | Plummer | 174/117 M X |
| 3,711,627 | 1/1973 | Maringulov | 174/117 M X |
| 4,159,394 | 6/1979 | Ross | 174/117 F X |

OTHER PUBLICATIONS

Mandel, A. P.; Ancient Art Turns Modern–The Woven Cable; Conference Proceedings of the 18th International Wire and Cable Symposium; Atlantic City, N.J. USA (Dec. 3–5, 1969).

Mandel, A. P.; Ancient Textiles and Modern Electronics; Conference Proceedings of the 1970 Electronic Components Conference; Washington, D.C. U.S.A. (May 13–15, 1970); pp. 368–379.

Schuh, A. G.; Flat Flexible Cable and Wiring—Types, Materials, Constructions, and Features; Insulation/Circuits; Oct. 1970; pp. 27–34.

Brochure; Woven Electronics; P.O. Box 189; Mauldin, S.C. 29662; 1972.

*Primary Examiner*—G. P. Tolin
*Assistant Examiner*—Morris H. Nimmo
*Attorney, Agent, or Firm*—Charles J. Ungemach

[57] ABSTRACT

A woven wire fanout in which a large plurality of wires of high density are split into several fanout sections to decrease the wire density for purposes of providing more readily solderable connections.

10 Claims, 3 Drawing Figures

WOVEN WIRE FANOUT

BACKGROUND OF THE INVENTION

In the field of electrical connections, it is sometimes found that a very high density of wires need to be individually connected to output terminals such as on printed circuit boards. For example, in certain electrostatic recorders, the recording head may comprise several thousand individual wires, or styli, lined up across the recording paper. Each of these wires is individually energized by the control circuitry and accordingly individual connections to each of the wires must be made. With a density of, perhaps, 200 wires per inch, the problem of bringing the wires to a terminal board and soldering them thereon becomes extremely difficult since the wires easily tangle and with such a high density, solder, or other, connections are nearly impossible to make.

SUMMARY OF THE INVENTION

The present invention reduces the density of the wires by splitting the wires into several groups or "fanouts" so that each fanout has a density of only a fraction of the original density thereby permitting individual soldering of the fanouts to terminal boards with considerably less difficulty. For example, if four separate fanouts are created, the density of the wires is one quarter of the original density and with this density, it is possible to create satisfactory solder connections to terminal boards. Of course, a smaller or larger number of fanouts can be used to increase or further reduce the density of wires on each fanout depending on the original density, the application and the ability to make minute connections.

Creating a plurality of fanouts, when wire is used, may be a difficult problem since, with so many wires to deal with, tangling and short circuiting may easily occur. In the present invention, it is proposed that the fanouts be created by weaving the electrical conductors in a predetermined pattern with the cross threads being made of an insulative material such as nylon. Each of the fanouts then becomes flexible and easily handled like a cloth and yet the wires are individually separated from one another and kept distinct and untangled by the cross threads.

DETAILED DESCRIPTION OF THE PREFERRED EMBODIMENT

Figure 1:
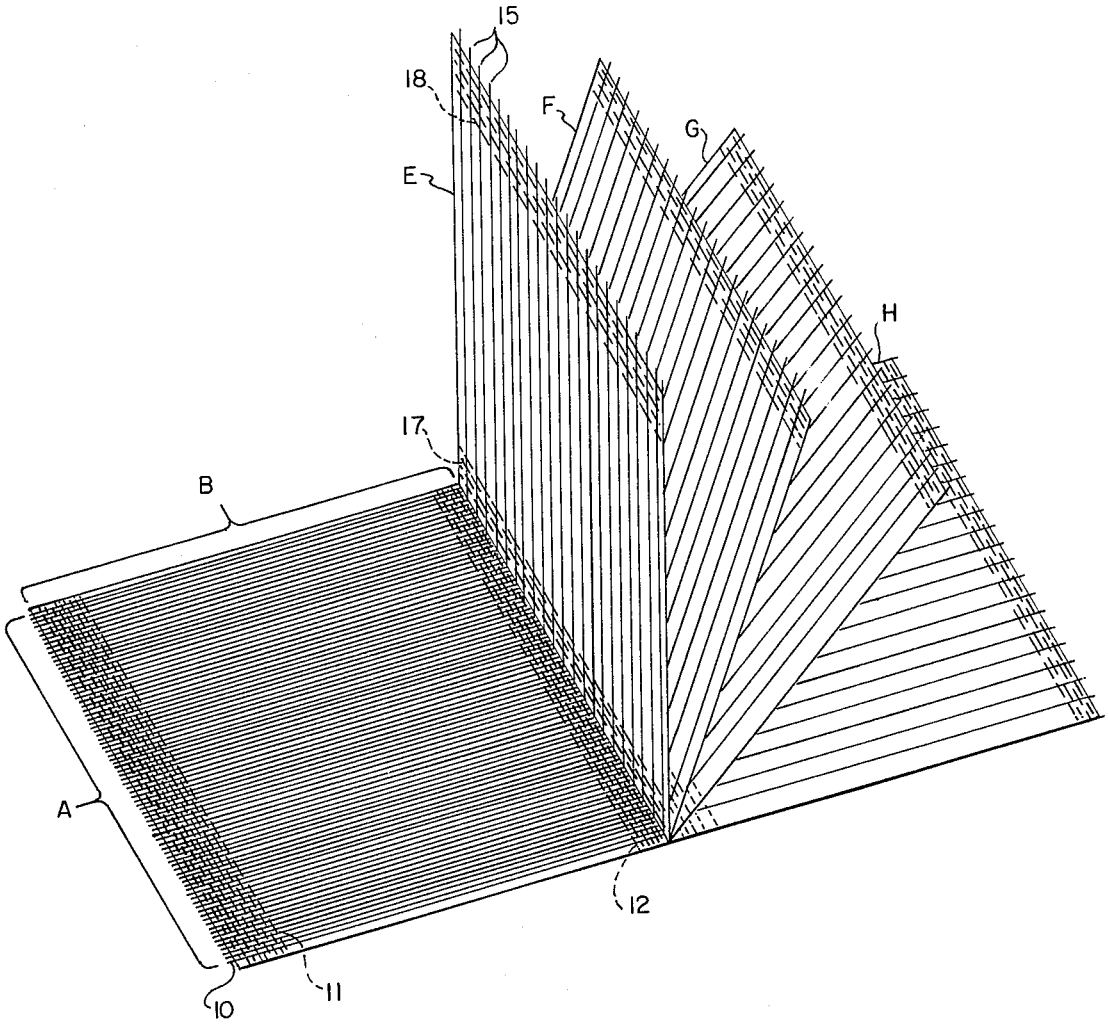
FIG. 1 shows a woven wire arrangement using four fanout sections.

In FIG. 1, a section, identified by reference numeral A consists of a high density group of parallel conductors such as shown by reference numeral 10. The density of the conductors in section A may be 200 wires per inch or more and the length of section A may be as wide as is necessary to accommodate all the conductors needed.

The individual wires, such as 10, are shown in FIG. 1 extending upwardly and to the right throughout a section identified by reference numeral B. In section B, which may be anywhere from an inch or two to ten or so inches, the wires are interwoven with a plurality of nylon cross threads such as is shown by reference numerals 11 and 12. The cross threads have not been shown throughout the entire section but it is to be understood that the entire section B would contain cross threads in sufficient number to space the wires apart from one another and hold the fabric together for use in, for example, placing the ends of the wires as styli into the recording head of an electrostatic recorder. In such recorders, the wire diameter may be of approximately 0.002 inches and accordingly, the nylon cross threads may be of similar diameter or of any convenient size desirable. Of course, the wires and cross threads need not be circular in cross section and it may be, for example, that ribbon shaped or other cross sections might be preferable.

After the section B in FIG. 1, the fabric is shown splitting off into four separate sections identified by reference numerals E, F, G and H respectively. The density of the wires, such as is shown by reference numeral 15 on section E in FIG. 1, is considerably less than the density of wires in section A and, as a matter of fact, with four fanout sections would normally be one quarter of the density. The wires in sections E, F, G and H are also held in position by nylon cross threads such as is shown by reference numerals 17 and 18 in section E of FIG. 1.

Figure 2:
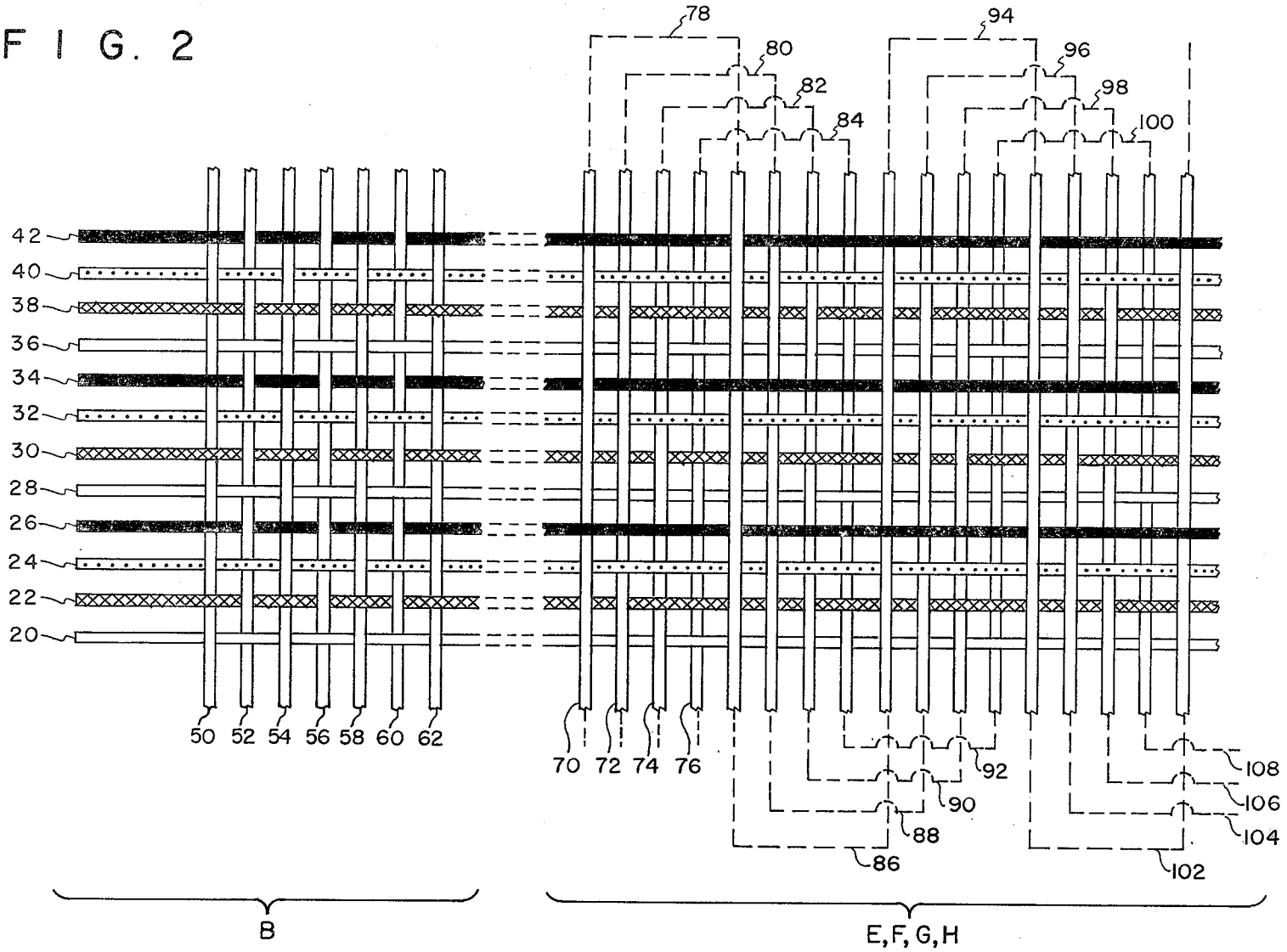
FIG. 2 shows the specific weaving which may be used to accomplish the fanning out of the sections shown in FIG. 1.

The entire arrangement can be woven as a unit in one plane with the fanout sections being separated after the weaving has been completed. Reference to FIG. 2 will show how this is accomplished.

In FIG. 2, 12 wires are shown identified by reference numerals 20, 22, 24, 26, 28, 30, 32, 34, 36, 38, 40 and 42 respectively. For ease in understanding the pattern, every fourth wire has been drawn so as to make it distinguishable from the others. As seen, wires 20, 28 and 36 are shown blank or white, wires 22, 30 and 38 are shown with x's therein, wires 24, 32 and 40 are shown with dots therein and wires 26, 34 and 42 are shown black. In the weave pattern that follows, the white wires will form one fanout, the x'd wires form a second fanout, the dotted wires form a third fanout and the black wires form a fourth fanout.

In FIG. 2, a section identified as B that corresponds to section B in FIG. 1, has a regular screen or close weave with a nylon thread such as 50, 52, 54, 56, 58, 60 and 62 being woven over and under every other wire throughout section B. In section B, therefore, the resulting arrangement will be a fabric which is nonseparable and held together like a screen or cloth. As mentioned above, the left ends of the wires 20–42 may be employed for such purposes as the styli of a recording head of an electrostatic recorder.

In FIG. 2, the section identified by reference numeral E, F, G and H corresponds to the fanout sections E, F, G and H of FIG. 1. This section is so woven that the individual sections E, F, G and H will separate into a fanout such as shown in FIG. 1. To this end, a first nylong thread, indentified by reference numeral 70, is shown passing over wires 20, 22 and 24, under wire 26, over wires 28, 30, 32, 34, 36, 38, 40 and under wire 42. Thus, it is seen that thread 70 is interwoven with the black wires 26, 34 and 42 but passes over all of the other wires.

A second nylon thread, identified by reference numeral 72, is shown passing over wires 20 and 22, under wires 24 and 26, over wires 28, 30 and 32, under wire 34, over wires 36 and 38 and under wires 40 and 42. Thus it is seen that thread 72 passes under all of the black wires, is interwoven with the dotted wires 24, 32 and 40 and passes over all of the x'd and white wires.

A third nylon thread, identified by reference numeral 74, is shown passing over wire 20, under wires 22, 24, 26, over wires 28 and 30, under wires 32 and 34, over wire 36, and under wires 38, 40 and 42. Thus, thread 74 passes under all of the black wires and the dotted wires, is interwoven with the x'd wires 22, 30 and 38 and passes over all of the white wires.

Finally, a fourth nylon thread, identified by reference numeral 76, is shown passing under wires 20, 22, 24 and 26, over wire 28 and under wires 30, 32, 34, 36, 38, 40 and 42. Thus, thread 76 passes under all black wires, all dotted wires and all x'd wires and is interwoven with the white wires 20, 28 and 36.

Thread 70 is shown in FIG. 2 connected by a dashed line connection 78 to be rewoven in the opposite direction through the black wires. Thus, thread 70 is seen coming down in its second pass over wires 42, 40, 38 and 36, under wire 34, over wires 32, 30, 28, 26, 24, 22 and 20. Thus, in its second pass, thread 70 passes over all of the white, x'd and dotted wires and is interwoven with the black wires in a fashion opposite to that first described.

Similarly, thread 72 is shown by a dotted line connection 80 to pass back through and interweave the dotted wires 40, 32 and 24. More particularly, thread 72, on its second pass, is shown passing under wire 42, over wires 40, 38, 36, under wires 34 and 32, over wires 30, 28, under wire 26, and over wires 24, 22 and 20 in its second pass. Thus, on its second pass, thread 72 passes under all of the black wires, over all of the x'd and white wires and is interwoven in a reverse manner to that first described with the dotted wires 40, 32 and 24.

In similar fashion, thread 74 is shown by dotted connection 82 to weave the x'd wires. More particularly, thread 74 on its second pass, passes under wires 42 and 40, over wires 38 and 36, under wires 34, 32 and 30, over wire 28, under wires 26, 24 and over wires 22 and 20. Thus it is seen that thread 74, on its second pass, passes under all of the black wires and all of the dotted wires and passes over the white wires while interweaving the x'd wires 38, 30 and 22.

Finally, in similar fashion, thread 76 is shown by a dotted line connection 84 to weave the white wires on its second pass. More particularly, thread 76, on its second pass, passes under wires 42, 40 and 38, over wire 36, under wires 34, 32, 30, 28, 26, 24 and 22 and over wire 20. Thus, on its second pass, thread 76 passes under all black, dotted and x'd wires while interweaving the white wires 36, 28 and 20.

Threads 70, 72, 74 and 76, after the second pass are shown continuing the weaving by dotted line connections 86, 88, 90 and 92 for the third pass, dotted line connections 94, 96, 98 and 100 for the fourth pass and with respect to thread 70, dotted line connection 102 for the fifth pass. Threads 72, 74 and 76 are shown exited by dotted line connections 104, 106 and 108 respectively although it is to be understood that further weaving of these wires would occur.

Since thread 70 passes over all of the white, x'd and dotted wires in all of its passes and since it interwove the black wires, it can be seen that all of the black wires can be lifted off the plane of the paper of FIG. 2 as a separate unit which would comprise fanout section E of FIG. 1.

After section E has been lifted, it will be noticed that since thread 72 passed over all of the white and x'd wires in all of its passes but interwove all of the dotted wires, that the dotted wires would be able to be lifted from the plane of the FIG. 2 to form the second fanout section F of FIG. 1.

Next it is seen that since thread 74 passed over all of the white wires and interwove the x'd wires, that it too could be lifted off the plane of the paper of FIG. 2 to form the woven fanout section G of FIG. 1 and this would leave the final fanout section H to be composed of the white wires interwoven with the nylon thread 76.

Of course, the lifting off of the sections E, F, G and H could not occur in the section B area since these wires are interwoven with a screen or close weave which makes them inseparable.

In FIG. 2, the cross threads for sections E,F,G and H are shown about one quarter as dense as the cross threads in Section B but if desired, the density of cross threads in sections E, F, G and H may be increased to improve the stability of the weave.

After weaving the fanout sections E, F, G and H to the desired length, the wires 20–42 would extend a predetermined distance beyond the end of the weave so that the individual wires could be maneuvered into position for connection to terminals as, for example, by soldering them to a printed circuit board.

Figure 3:
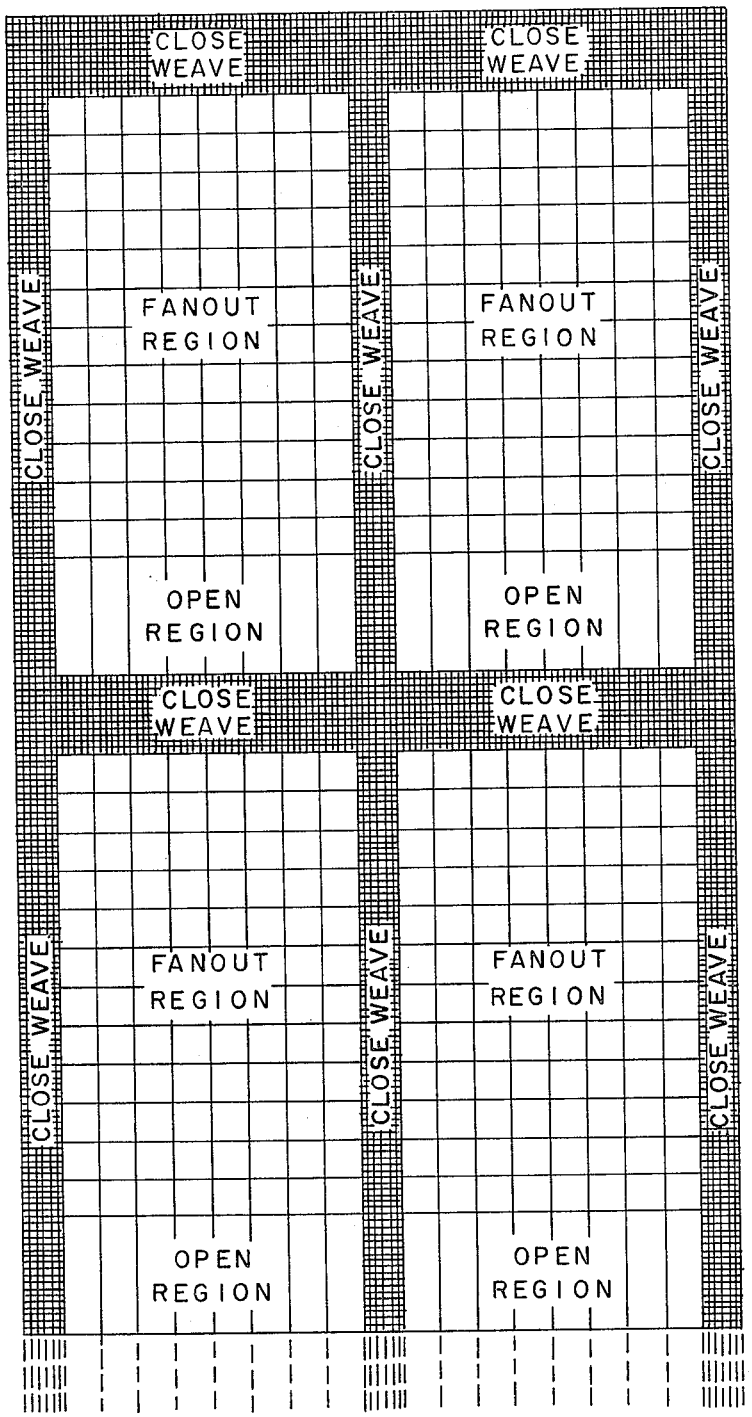
FIG. 3 shows how several woven wire connection arrangements may be made in one weaving.

FIG. 3 shows an arrangement for making a number of woven wire fanout groupings simultaneously. In FIG. 3, a large number of wires are arranged vertically in parallel fashion in the loom. The nylon cross fibers are woven in horizontal fashion in FIG. 3. Starting at the top of FIG. 3, in a section identified as "close weave", the nylon threads are interwoven in a fashion similar to that of sections B of FIGS. 1 and 2. After the initial close weave section has occurred, the nylon cross threads begin weaving in the fanout section by first providing a "close weave" for the first few vertical wires so as to hold the edges of each connector grouping together. After close reweaving the first few wires, the nylon cross threads are woven throughout the "fanout region" in the manner shown with respect to sections E, F, G and H of FIG. 2. This continues to a width for which the fanout section is desired after which another "close weave" section is created by the nylon threads weaving a few more wires and then a second "fanout region" is woven in a manner similar to that shown in FIG. 2 and finally the last few vertical wires are interwoven in a "close weave" so as to hold the edges together. This continues throughout the fanout section after which no nylon cross threads are used for a period, shown in FIG. 3 as the "open region". The open region will consist only of vertical wires which will be used to be connected to the printed circuit board or terminals as desired. After the "open region", another "close weave" region is begun to correspond to another section B such as shown in FIGS. 1 and 2 and, as described above, after the second close weave region, another "fanout region" is woven in the manner similar to that described in connection with sections E, F, G and H of FIG. 2 and subsequently another "open region" in which there will be no cross threads and the wires will be used to connect to the desired terminal boards or other connections. This would continue for as long as needed so that a large number of connection arrangements can be made with this single weaving. The material may be cut at the end of the weaving so that, as shown in FIG. 3, four separate connection arrangements would be created. Of course, the vertical "close weave" sections would have to be eliminated when the arrangement is put into use in order to open the fanout region into the desired fanouts. To simplify this, a few more wires than necessary may be included so that it will be easier to cut the close weave sections away without cutting a wire to be used.

It is thus seen that I have provided a structure for reducing the density of wires into separate fanout sections for use in connecting them to terminal boards while all the time keeping them under control. It is understood that there are many obvious modifications and changes that could be made to the preferred embodiment. For example, the four fanout sections were only used as an example and fewer or more than four could be accomplished utilizing the same weaving pattern as that shown in the preferred embodiment. Also, the wires have been shown as the warp and the threads as the woof in the preferred embodiment. It is quite possible to reverse this arrangement and weave the wires as the woof through the threads as the warp. Also, the wires may be insulated in which case the threads could be conductive. Accordingly, I do not wish to be limited to the specific structure shown in connection with the preferred embodiment but I intend only to be limited by the following claims.

The embodiments of the invention in which an exclusive property or right is claimed are defined as follows:

1. A woven assembly comprising:

a plurality of spaced parallel electrical wires having a length and, as measured transverse to the length, having a first density in number of wires per unit distance;

thread means interwoven with said wires to form a first mat of spaced parallel wires having the first density, said thread means interwoven with a first group of said wires to form a second mat of spaced parallel wires of a density less than the first density, said thread means interwoven with a second group of said wires to form a third mat of spaced parallel wires of a density less than the first density, the third mat positioned atop the second mat subsequent to the thread means being interwoven with the first and second groups of said wires but being separable from the second mat for use of the electrical wires.

2. The assembly according to claim 1 wherein the wires are bare conductors and the thread means is nonconductive.

3. A woven assembly comprising:

a plurality of wires having a length;

thread means (1) throughout a first portion of the length being interwoven with all of said wires so that said wires are held in spaced parallel relationship, (2) throughout a second portion of the length (a) being interwoven with a first group of nonadjacent ones of said wires so that the wires of the first group are held in spaced parallel relationship and (b) being interwoven with a second group of nonadjacent ones of said wires so that the wires of the second group are held in spaced parallel relationship and are separable from the wires of the first group.

4. The assembly according to claim 3 wherein the wires are bare conductors and the thread means is nonconductive.

5. Apparatus comprising, in combination:

a plurality of spaced parallel wires;

thread means interwoven with said wires to form a woven assembly with a first portion in which all of the wires are relatively fixedly positioned by said thread means, a second portion in which a first group of nonadjacent ones of said wires are relatively fixedly positioned by said thread means and a third portion in which a second group of nonadjacent ones of said wires are relatively fixedly positioned by said thread means, the wires of the first and second groups being separable from each other throughout the second and third portions but nonseparable throughout the first portion.

6. Apparatus according to claim 5 wherein the wires are bare conductors and the thread means is nonconductive.

7. A woven assembly comprising:

a plurality of electrical wires having a length;

thread means interwoven with said wires throughout a first portion of the length to position said wires in substantially parallel relationship with each wire spaced from its neighbors by approximately a first distance, the thread means interwoven with a first group of said wires throughout a second portion of the length to position the wires of the first group in substantially parallel relationship with each wire spaced from its neighbors by approximately a second distance at least twice the first distance, the thread means interwoven with a second group of said wires throughout the second portion of the length to position the wires of the second group in substantially parallel relationship with each wire spaced from its neighbors by approximately the second distance.

8. The assembly according to claim 7 wherein said wires are bare conductors and the thread means is nonconductive.

9. A woven wire fanout for increasing the distance between a pluraiity of closely spaced electrical wires comprising:

a plurality of electrical wires having a length and arranged in substantially parallel relationship;

thread means interwoven with said wires to hold them with a small first distance between adjacent wires throughout a first portion of their length, the thread means interwoven with alternate groups of every fourth wire throughout a second portion of their length so as to provide four separable mats of parallel wires with the distance between adjacent wires in each mat being approximately four times greater than the first distance.

10. The fanout according to claim 9 wherein said wires are bare conductors and said thread means is nonconductive.

* * * * *